US005166727A

United States Patent [19]

Miyamoto et al.

[11] Patent Number: 5,166,727

[45] Date of Patent: Nov. 24, 1992

[54] STRUCTURE FOR COOLING PROCESS CARTRIDGE OF IMAGE FORMING APPARATUS

[75] Inventors: Takayuki Miyamoto; Takashi Saito; Keiichiro Suzuki, all of Hachioji, Japan

[73] Assignee: Konica Corporation, Tokyo, Japan

[21] Appl. No.: 859,992

[22] Filed: Mar. 30, 1992

[30] Foreign Application Priority Data

Apr. 4, 1991 [JP] Japan ..... 3-71622
Apr. 4, 1991 [JP] Japan ..... 3-71623

[51] Int. Cl.[5] ..... G03G 15/00

[52] U.S. Cl. ..... 355/200; 355/202; 355/210; 355/298; 355/30; 165/47

[58] Field of Search ..... 355/200, 210, 211, 215, 355/30, 202, 298; 165/47

[56] References Cited

U.S. PATENT DOCUMENTS 4,830,091 5/1989 Dierke et al. ..... 165/47 X
4,891,678 1/1990 Ishizu et al. ..... 355/298 X
5,038,174 8/1991 Kato et al. ..... 355/215
5,081,496 1/1992 Takeda ..... 355/215

FOREIGN PATENT DOCUMENTS 0083569 3/1990 Japan ..... 355/210
0107953 5/1991 Japan .

*Primary Examiner*—A. T. Grimley
*Assistant Examiner*—Matthew S. Smith
*Attorney, Agent, or Firm*—Jordan B. Bierman

[57] ABSTRACT

To prevent toner in a waste toner collection box incorporated in a process cartridge from becoming melted and solidified due to the heat generated by a fixing device positioned below the waste toner collection box, a duct is provided therebetween. The duct may be integrally provided below the waste toner collection box or above the fixing device. A fan, which faces one end of the duct, moves the air therein. One or both ends of the duct may be provided with a handle, which also serves as a wide mouthed extension to the duct.

4 Claims, 6 Drawing Sheets

STRUCTURE FOR COOLING PROCESS CARTRIDGE OF IMAGE FORMING APPARATUS

BACKGROUND OF THE INVENTION

The present invention relates to a structure for cooling a process cartridge of an image forming apparatus including a photoreceptor drum by which a toner image is transferred onto a recording medium, and a recovery box into which residual toner is recovered, wherein the recovery box is disposed above a fixing unit by which the toner image transferred onto the recording medium is thermally fixed.

In a conventional image forming apparatus, residual toner on a photoreceptor drum is recovered into a toner recovery box, and when the toner recovery box has been loaded fully with the recovered toner, or when a predetermined period of time has passed, the toner recovery box is replaced or the recovered toner in the recovery box is discharged.

In general, this toner recovery box is incorporated into a process cartridge together with the photoreceptor, and in many cases, the toner recovery box is disposed above a fixing unit.

However, when the toner recovery box is disposed in a position above a fixing unit, the toner contained in the recovery box is fused by the heat produced by the thermal fixing unit, and the fused toner is solidified when it is cooled. The solidified toner is formed into a lump in the vicinity of the inlet of the toner recovery box, which decreases the capacity of the toner recovery box, and in some cases, the toner recovery box is blocked by the lump.

In order to prevent such a problem, the following countermeasures have been taken:

(1) The toner recovery box is disposed at some distance away from the fixing unit which is a heat source.

(2) A fan is provided on one side of the image forming apparatus so that cooling air is introduced from the outside into the space defined by the toner recovery box and the fixing unit in order to cool the toner recovery section.

However, the problems with such an apparatus are that:

(1) A large space is required between the toner recovery box and the fixing unit, so that the size of the image forming apparatus becomes large.

(2) Flow velocity of introduced air is low, so that its cooling efficiency is low.

In a conventional image forming apparatus, handles are provided on both sides of the process cartridge so that the process cartridge can be easily attached to and detached from the apparatus.

A problem with such handles is that the size of the apparatus in the longitudinal direction is increased.

It is a primary object of the present invention to provide a structure for cooling a process cartridge of an image forming apparatus, characterized in that: the size of the space required in the apparatus, is reduced; the toner recovery box is effectively cooled; and the apparatus is made compact.

SUMMARY OF THE INVENTION

The first structure according to the present invention is described as follows:

In an image forming apparatus provided with a process cartridge including a photoreceptor drum which transfers a toner image onto a recording sheet, and further including a toner recovery box section which is disposed over a fixing unit when the process cartridge is mounted to the apparatus, wherein residual toner on the photoreceptor is accommodated in the toner recovery section, a fan is provided on one side of the image forming apparatus, and a duct is integrally contacted with the lower surface of the toner recovery box, and on end of the duct is opposed to the fan and the other end is opposed to the other side of the image forming apparatus.

The second structure according to the present invention is described as follows:

In an image forming apparatus provided with a process cartridge including a photoreceptor drum which transfers a toner image onto a recording sheet, and further including a toner recovery box section disposed over a fixing unit, wherein residual toner on the photoreceptor is accommodated in the toner recovery section, a fan is provided on one side of the image forming apparatus, and a duct is provided on the fixing unit, wherein the upper surface of the duct faces the lower surface of the toner recovery box, and one end of the duct is opposed to the fan and the other end is opposed to the other side of the image forming apparatus.

In the first structure for cooling the process cartridge of the image forming apparatus, when the fan is driven, the air in the duct provided below the lower surface of the process cartridge is moved to prevent heat transmission to the toner recovery box section. Consequently, the toner recovery section can be cooled.

In the second structure for cooling the process cartridge of the image forming apparatus, when the fan is driven, the air in the duct provided on the fixing unit is moved to prevent heat transmission to the toner recovery box section. Consequently, the toner recovery section can be cooled.

The third structure according to the present invention is described as follows:

In an image forming apparatus to which is detachably provided a process cartridge including a photoreceptor drum that transfers a toner image onto a recording sheet, and further including a toner recovery box spaced from a fixing unit leaving a predetermined space, wherein the residual toner on the photoreceptor drum is stored in the toner recovery box, the image forming apparatus comprises: a fan which is disposed on one side of the image forming apparatus opposed to the space; an air supply hole formed on the other side of the image forming apparatus opposed to the space; and a first handle section in which a through hole is formed, is protruded from one side of the lower surface of the toner recovery box, wherein the sectional area of the through hole is tapered as it goes into the apparatus.

The fourth structure of the present invention is characterized by a second handle section in which a through hole is protruded from one side of the lower surface of the toner recovery box of the process cartridge and opposed to the air supply hole, wherein the sectional area of the through hole is tapered as it goes inside.

In the image forming apparatus of the third structure, cooling air flows in such a manner that: when the fan is driven, air is introduced from the outside of the apparatus; the introduced air passes through the second handle section and the space formed between the toner recovery box of the process cartridge and the fixing unit; and then the air is discharged to the outside of the apparatus through the first handle section.

When the air passes through the space between the toner recovery box and the fixing unit, the bottom surface of the toner recovery box is cooled.

The first handle section is used as a handle when the process cartridge is handled.

In the case of the image forming apparatus of the fourth structure, the second handle section is also used as a handle when the process cartridge is handled.

DETAILED DESCRIPTION OF THE PREFERRED EMBODIMENTS

Figure 1:
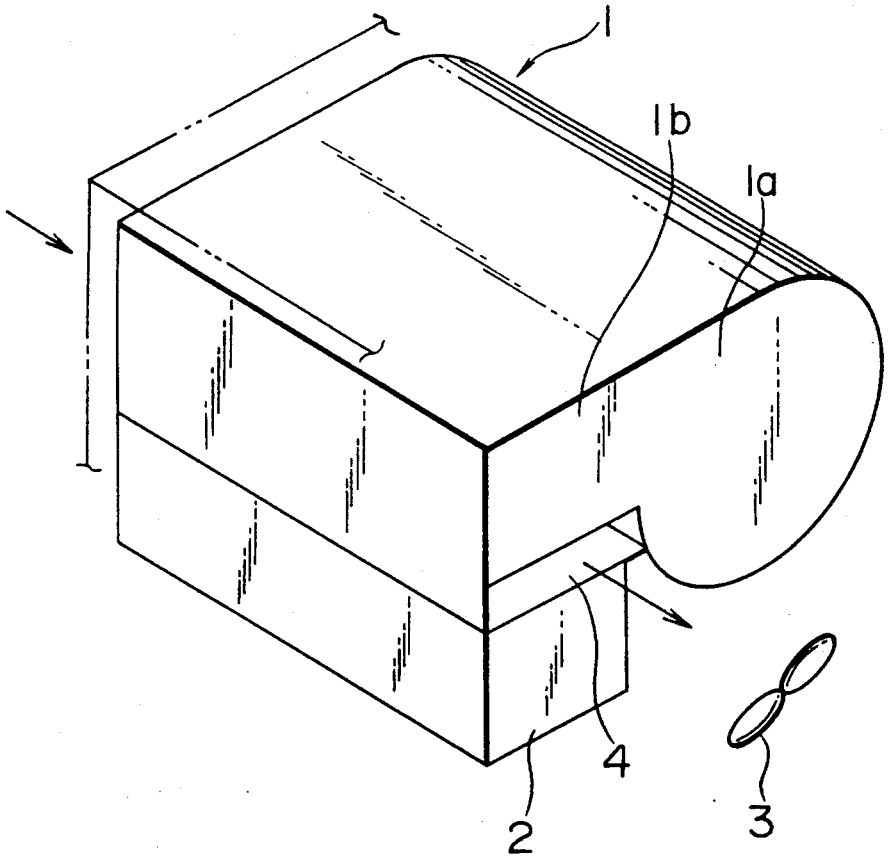
FIG. 1 is a schematic illustration explaining the principle of the present invention.

Referring to FIG. 1, the essential structure of the first example of the present invention will be explained as follows. In FIG. 1, numeral 1 is a process cartridge including a photoreceptor drum 1*a* by which a toner image is transferred onto a recording sheet, and toner recovery box 1*b* which is disposed above a fixing unit 2 and by which residual toner on the photoreceptor drum is recovered and stored, wherein a transferred toner image is thermally fixed by the fixing unit 2.

A fan 3 is provided on one side of the image forming apparatus. A duct 4 is provided in the lower portion of the toner recovery box 1*b* of the process cartridge 1. One end of the duct 4 is opposed to the fan 3, and the other end is opposed to the other side of the image forming apparatus. In FIG. 1, the duct 4 is formed integrally with the lower surface of the process cartridge 1. However, the duct 4 may be formed separately from the process cartridge 1 in such a manner that the upper surface of the duct 4 is opposed to the bottom surface of the toner recovery box 1*b*.

According to the structure, cooling air is moved inside the duct 4 when the fan 3 is driven, so that the bottom surface of the toner recovery box 1*b* is cooled in order to prevent the increase in temperature inside the toner recovery box 1*b*.

Figure 2:
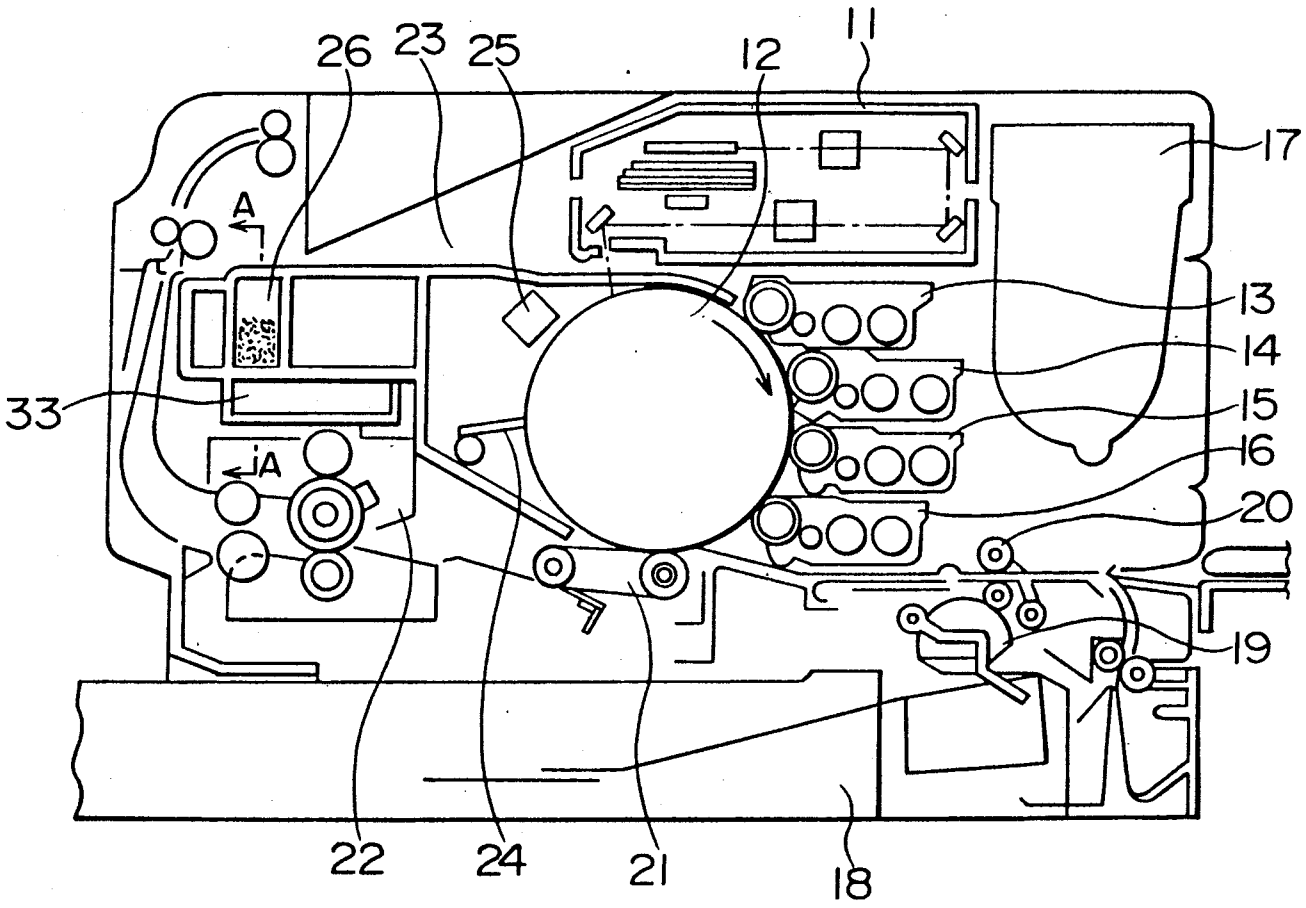
FIG. 2 is a schematic illustration showing the structure of an image forming apparatus by which the first example of the present invention is explained.

Next, referring to FIGS. 2 and 3, an example of the present invention will be explained as follows. First, with reference to FIG. 1, the image forming apparatus of this example is explained. The image forming apparatus of this example is a color printer. In this color printer, numeral 11 is a laser writing unit by which an electrostatic latent image is written on a photoreceptor drum 12 with laser beams. Four developing units, which are a yellow developing unit 13, magenta developing unit, cyan developing unit 15 and black developing unit, are provided around the photoreceptor drum 12. Numeral 17 is a toner supply unit which supplies toner of each color to the developing units. Numeral 18 is a cassette in which a plurality of recording sheets are set. Numeral 19 is the first paper feed roller which takes out a recording sheet from the cassette 18 and conveys it to the second paper feed roller. Numeral 21 is a transfer section which transfers a toner image formed on the photoreceptor drum onto a recording sheet fed by the second paper feed roller 20 at a predetermined timing. Numeral 22 is a fixing unit which thermally fixes the toner image transferred onto the recording sheet.

A process cartridge 23 of this example integrally includes the photoreceptor drum 12, cleaning blade 24 which scrapes off the residual toner on the photoreceptor drum 12, electrode 25 which conducts corona discharge on the photoreceptor drum 12 in order to give a uniform electrical charge to the drum, and toner recovery box 26 in which the toner scraped off by a cleaning blade 24 is accommodated.

Figure 3:
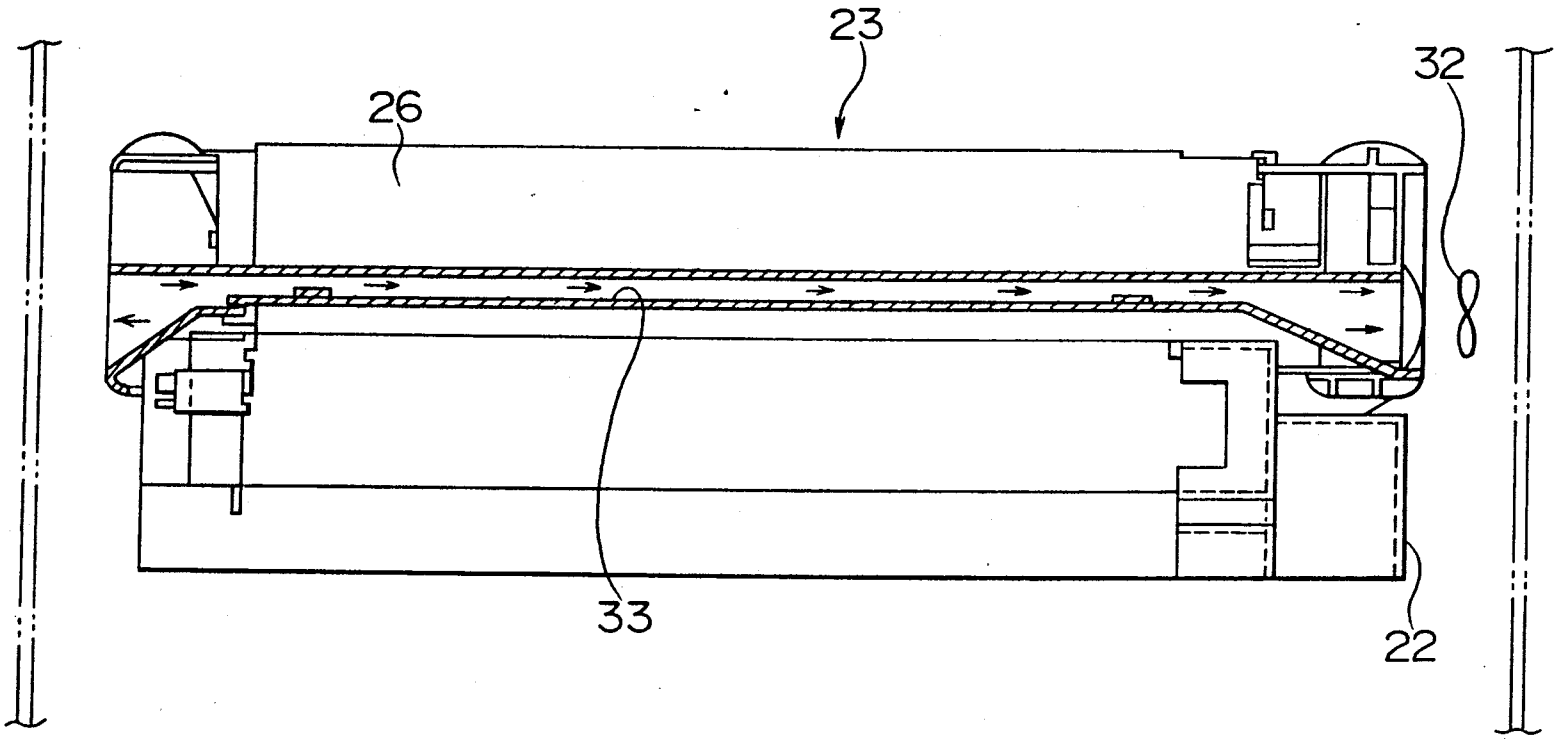
FIG. 3 is a sectional view taken on line A—A in FIG. 2.

As shown in FIG. 3, a fan 32 is provided on one side of the color printer of this example. A duct 33, one end of which is opposed to the fan 3 and the other end of which is opposed to the other side of the color printer, is provided on the lower side of the toner recovery box 26 of the process cartridge 23. In this example, slits are formed on both sides of the color printer close to the ends of the duct 33.

Next, the operation of the color printer will be explained. A recording sheet is taken out of the cassette 18 by the first paper feed roller 19, and then conveyed to the second paper feed roller 20. An electrostatic latent image is formed on the photoreceptor drum by the laser writing unit 11. After that, toner images of various colors are formed by the developing units 13–16. The recording sheet is conveyed to the transfer section 21 by the second paper feed roller 20. In the transfer section, the toner image is transferred onto the recording sheet from the surface of the photoreceptor drum 12. Then, the recording sheet onto which the image has been transferred, is conveyed to the fixing unit 22 in which the toner image is thermally fixed onto the recording sheet. Then, the recording sheet is discharged outside the apparatus.

When the color printer is turned on, the fan 32 is always driven. When the fan 32 is driven, cooling air is always moved inside the duct, either fed into the duct or sucked out of the duct.

According to the structure, when the fan 32 is driven, the air inside the duct 33 is moved so that the heat generated by the fixing unit 22 is prevented from being transmitted to the toner recovery box 26, and accordingly the toner recovery box 26 can be cooled.

Consequently, the toner recovery box 26 can be disposed closer to the fixing unit 22, so that the size of the apparatus can be reduced.

The speed of air moving inside the duct is far faster than that of air flowing in the conventional open state without a duct. Therefore, the cooling efficiency can be improved.

It should be appreciated that the present invention is not limited to the specific example. In the example, the duct 33 is provided integrally with the process cartridge 23. However, the same effect can be obtained when the duct 33 is provided on the fixing unit 22 in such a manner that the upper surface of the duct 33 is opposed to the bottom surface of the toner recovery box 26.

The image forming apparatus to which the present invention can be applied, is not limited to a color printer, but the present invention can be applied to a monochrome printer and a copier.

Figure 4:
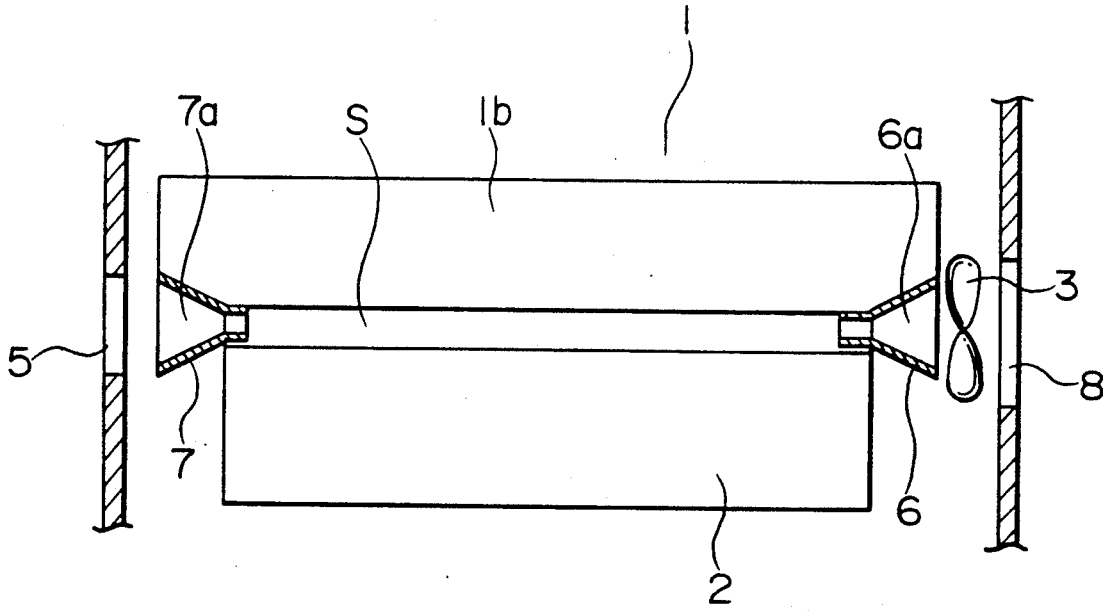
FIG. 4 is a schematic illustration explaining the principle of the second example of the present invention.

Referring now to FIG. 4, the essential structure of the second example of the present invention will be explained as follows. Numeral 1 is a detachable process cartridge including: a photoreceptor drum by which a toner image is transferred onto a recording sheet; and a toner recovery box 1*b* which is spaced from the fixing unit 2 that thermally fixes the image transferred onto the recording sheet, leaving space S between the toner recovery box and the fixing unit, thereby the toner recovered from the surface of the photoreceptor drum is accommodated in the toner recovery box.

The fan 3 is provided on one side of the image forming apparatus in such a manner that the fan 3 is opposed to space S, and further, an exhaust hole 8 is formed on one side of the image forming apparatus in such a manner that the exhaust hole is opposed to the fan 3. An air supply hole 5 is formed on the other side of the image forming apparatus in such a manner that the air supply hole is opposed to space S.

As shown in FIG. 4, the first handle section 6 is formed on the lower surface on one side of the toner recovery box 1*b*, wherein the first handle section 6 is provided with a through hole 6*a* which is protruded toward the fixing unit 2 and opposed to the fan 3, and the sectional area of which is gradually tapered as it goes to the inside of the apparatus. The second handle section 7 is formed on the lower surface on the other side of the toner recovery box 1*b*, wherein the second handle section 7 is provided with a through hole 7*a* which is protruded toward the fixing unit 2 and opposed to the air supply hole 5, and the sectional area of which is gradually tapered as it goes to the inside of the apparatus.

Next, the operation of the apparatus of the structure will be explained as follows. When the fan 3 is driven, outside air is introduced into the apparatus through the air supply hole 5. The introduced air enters space S formed between the process cartridge 1 and the fixing unit 2 through tapered through hole 7*a* of the second handle section 7, being sucked by the fan 3. Then, the air advances to the first handle section 6. After that, the air is discharged outside through the through hole 6*a* of the first handle section 6.

According to the structure, the toner recovery box 1*b* is cooled by the air passing below the bottom surface of the toner recovery box 1*b* of the process cartridge 1. Therefore, the increase in temperature can be prevented inside the toner recovery box 1*b*.

The first and the second handle section in which the through holes 6*a*, 7*a* are formed, serves as a handle for the process cartridge 1. Further, these handle sections 6, 7 are protruded from the lower surface of the process cartridge 1 toward the fixing unit 2, so that the width of the process cartridge is not increased and the apparatus can be made compact.

Figure 5:
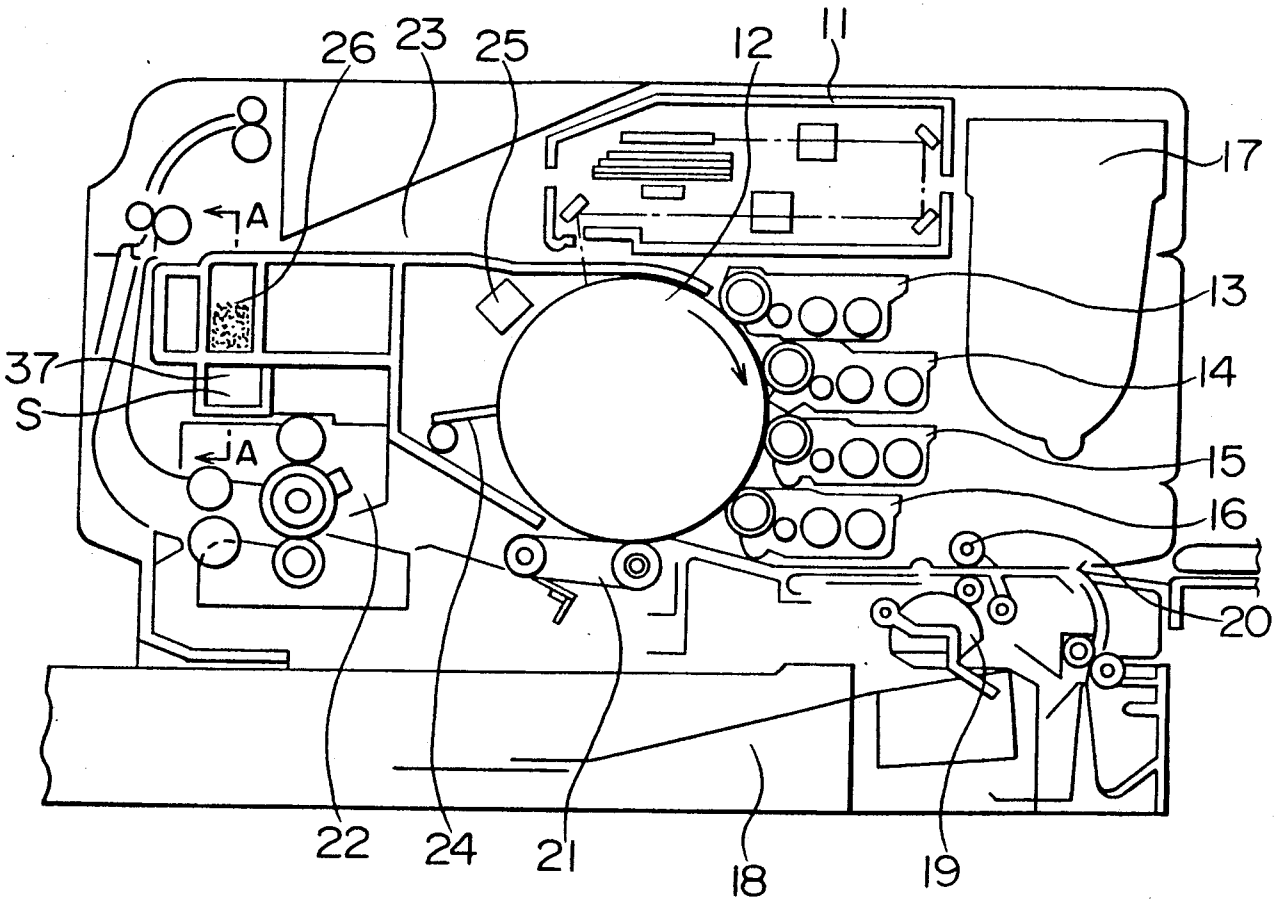
FIG. 5 is a schematic illustration showing the structure of an image forming apparatus by which the second example of the present invention is explained.
Figure 6:
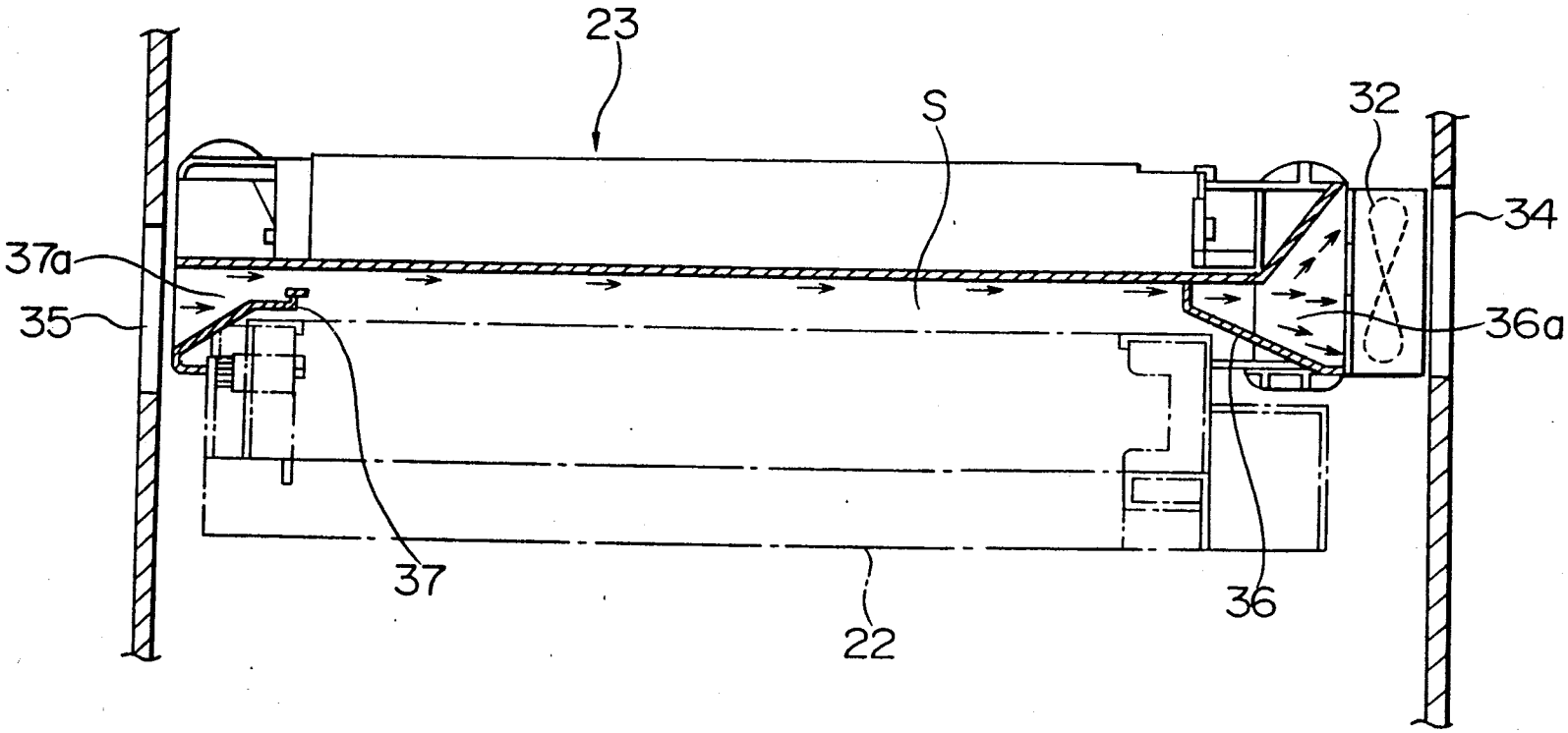
FIG. 6 is a section taken on line A—A in FIG. 5.

Referring to FIGS. 5 and 6, the difference between the first and the second example of the present invention will be explained as follows. First, In FIG. 5, the process cartridge 23 of the present invention is spaced from the fixing unit 22, leaving a predetermined space S.

As shown in FIG. 6, in the color printer of this example, the fan 32 is provided on one side of the apparatus. Further, the exhaust hole 34 is formed on one side of the image forming apparatus in such a manner that the exhaust hole 34 is opposed to the fan 32. The air supply hole 35 is formed on the other side of the image forming apparatus in such a manner that the air supply hole 35 is opposed to space S.

The first handle section 36 is formed to the lower surface on one side of the toner recovery box 26, provided with a through hole 36*a* which extends toward the fixing unit 22 and is opposed to the fan 32, and the sectional area of which is gradually tapered as it goes to the inside of the apparatus. The second handle section 37 is formed to the lower surface on the other side of the toner recovery box 26, provided with a through hole 37*a* which extends toward the fixing unit 22 and is opposed to the air supply hole 35, and the sectional area of which is gradually tapered as it goes to the inside of the apparatus.

The operation of a color printer having the structure will be explained below. When the electrical power source of the color printer is turned on, the fan 32 is always driven. When the fan 32 is driven, the air outside the apparatus is introduced into the apparatus through the air supply hole 35. The introduced air enters space S between the process cartridge 23 and the fixing unit 22 through the tapered through hole 37*a* of the second handle section 37, and advances to the first handle section 36. After that, the air is discharged outside through the through hole 36*a* of the first handle section 36 and the exhaust hole 34.

According to the structure, the toner recovery section 26 is cooled by the air passing below the bottom surface of the toner recovery section 26, so that the increase in temperature of the toner recovery section 26 can be prevented.

Therefore, even when the space between the toner recovery box and the fixing unit is small, the toner recovery section can be sufficiently cooled. Additionally cooling air is introduced into space S from the outside through the through hole 37*a*, so that the flow speed is increased and the cooling efficiency can be improved.

Further, the through holes 36*a*, 37*a* of the first and the second handle section 36, 37 serve as a handle of the cartridge 23. These handle sections 36, 37 are protruded downwardly toward the fixing unit 22 from the lower surface of the cartridge 23, so that it is not necessary to increase the transverse size of the process cartridge 23. Consequently, the apparatus can be made compact.

In this embodiment, the handles are provided to both sides of the process cartridge 23. That is, the handles are provided to the first and the second handle section 36, 37. However, even when only the first handle section 36 is provided, that is, only the tapered through hole 36*a* is provided, it is possible to increase the flow speed of air, and the operator can insert his finger into space S when he handles the apparatus, so that the second handle 37 is not always necessary.

As described above, according to the present invention, the air duct is provided in the lower portion of the toner recovery box section, and cooling air flows in the duct, being sucked or forced by the fan. Accordingly, the apparatus can be made compact and the toner recovery box can be effectively cooled. In the manner mentioned above, an excellent cooling structure of the process cartridge can be realized.

When the handle sections having the tapered through hole are provided on the side of the process cartridge, the toner recovery box section can be effectively cooled while the size of the apparatus is reduced.

What is claimed is:

1. An image forming apparatus comprising:

(a) a process cartridge having (1) a photoreceptor from which a toner image is transferred to a recording material and (2) a waste toner container in which residual toner from the surface of the photoreceptor is collected;

(b) fixing means disposed in a position below the waste toner container, for thermally fixing the toner image on the recording material;

(c) a duct integrally provided to the bottom surface of the waste toner container, one open end of the duct being disposed to face one lateral side of the apparatus; and (d) a fan, provided to the other lateral side of the apparatus and provided to face the other open end of the duct, for moving the air in the duct.

2. An image forming apparatus comprising:

(a) a process cartridge having (1) a photoreceptor from which a toner image is transferred to a recording material and (2) a waste toner container in which residual toner from the surface of the photoreceptor is collected;

(b) fixing means disposed in a position below the waste toner container, for thermally fixing the toner image on the recording material;

(c) a duct integrally provided to the top surface of the fixing means, the top surface of the duct being disposed to face the bottom surface of the wasted toner container, one open end of the duct being disposed to face one lateral side of the apparatus; and (d) a fan, provided to the other lateral side of the apparatus and provided to face the other open end of the duct, for moving the air in the duct.

3. An image forming apparatus comprising:

(a) a process cartridge detachable from the apparatus, having (1) a photoreceptor from which a toner image is transferred to a recording material and (2) a waste toner container in which residual toner from the surface of the photoreceptor is collected;

(b) fixing means spaced from the bottom surface of the waste toner container to have a predetermined space, for thermally fixing the toner image on the recording material (c) a fan provided to one lateral side of the apparatus and disposed to face the predetermined space, for moving the air in the predetermined space;

(d) an air intake provided to the other lateral side of the apparatus, the air intake being disposed to face the predetermined space; and (e) a first handle having a through hole, provided to protrude from one lateral side of the bottom surface of the waste toner container toward the fixing means and provided to face the fan, the cross-sectional area of the through hole increasing as the through hole approaching an edge of the first handle.

4. The apparatus of claim 3, further comprising a second handle having a through hole communicated with the through hole of the first handle, the second handle being provided to protrude from the other lateral side of the bottom surface of the container toward the fixing means and provided to face the air intake, a cross-sectional area of the second handle increasing as the through hole approaching the edge of the second handle.

* * * * *